United States Patent [19]

McVeigh

[11] 4,045,218

[45] Aug. 30, 1977

[54] METHOD FOR ELECTROSTATICALLY PRODUCING A COLOR ACCENTED PHOTOCOPY

[75] Inventor: James H. McVeigh, Rochester, N.Y.

[73] Assignee: Xerox Corporation, Stamford, Conn.

[21] Appl. No.: 591,583

[22] Filed: June 30, 1975

Related U.S. Application Data

[62] Division of Ser. No. 456,090, March 29, 1974, Pat. No. 3,914,043.

[51] Int. Cl.[2] ..... G03G 5/12

[52] U.S. Cl. ..... 96/1.2; 96/1.3; 355/4; 355/14

[58] Field of Search ..... 96/1.2, 1.3; 355/3 R, 355/4, 14, 17

[56] References Cited

U.S. PATENT DOCUMENTS

| | | | |
|---|---|---|---|
| 3,045,644 | 7/1962 | Schwertz | 355/4 X |
| 3,117,488 | 1/1964 | Giordano | 355/4 X |
| 3,532,422 | 10/1970 | McFarlane | 355/4 |
| 3,574,456 | 4/1971 | Grace | 355/4 |
| 3,788,737 | 1/1974 | Kidd | 355/14 X |
| 3,815,988 | 6/1974 | McVeigh et al. | 355/4 X |

*Primary Examiner*—Fred L. Braun

*Attorney, Agent, or Firm*—J. J. Ralabate; C. A. Green; H. Fleischer

[57] ABSTRACT

A method for color accenting selected portions of a photocopy wherein a photoconductive surface is exposed to a light image of the document being reproduced, the non-selected portions of the resulting latent image are erased prior to developing the image with a given colored toner, and the developed image is transferred to a copy sheet before a subsequent reproduction of the document is performed. During the subsequent reproduction, the non-selected portions of the latent image remain on the photoconductive surface and the selected portions are erased prior to development with a different color than the given colored toner of the non-selected portions of the document and the transfer of the non-selected portions to the same copy sheet that previously received the selected portions.

4 Claims, 4 Drawing Figures

METHOD FOR ELECTROSTATICALLY PRODUCING A COLOR ACCENTED PHOTOCOPY

This is a division of application Ser. No. 456,090, filed Mar. 29, 1974, now U.S. Pat. No. 3,914,043 issued to McVeigh on Oct. 21, 1975.

BACKGROUND OF THE INVENTION

This invention relates to an electrostatographic printing machine, and more particularly concerns an apparatus for forming copies of an original document wherein selected portions of the copy are highlighted in a color other than the remainder thereof.

In electrostatographic printing, an electrostatic latent image is created and reproduced in viewable form. The process of electrostatographic printing includes electrophotographic and electrographic printing. Electrophotographic printing employs a photosensitive medium to form, with the aid of electromagnetic radiation, an electrostatic latent image. Contrawise, electrographic printing employs an insulating medium to form, without the aid of electromagnetic radiation, an electrostatic latent image. Hereinafter, an electrophotographic printing machine will be described as an illustrative embodiment of the invention concept described in the present application.

Electrophotographic printing, as disclosed in U.S. Pat. No. 2,297,691 issued to Carlson in 1942, describes exposing a charged photoconductive member to a light image of an original document. The irradiated areas of the photoconductive surface are discharged to record thereon an electrostatic latent image corresponding to the original document. Development of the electrostatic latent lamp is achieved by bringing a developer mix into contact therewith. A typical developer mix employs colored heat settable plastic particles known generally as toner particles, which are mixed with ferromagnetic granules, i.e., carrier granules. The developer mix is selected such that the toner particles acquire the appropriate charge relative to the electrostatic latent image recorded on the photoconductive surface. As the developer mix is moved into contact with the photoconductive surface, the greater attractive force of the electrostatic latent image causes the toner particles to be separated from the carrier granules and to adhere to the electrostatic latent image. The toner powder image adhering to the electrostatic latent image is, then, transferred to the sheet of support material. A suitable sheet of support material is paper, or a thermoplastic sheet, amongst others. Subsequently, the toner powder image is permanently affixed to the sheet of support material or copy sheet.

Essentially, multi-color printing repeats the foregoing process a plurality of cycles. For example, U.S. Pat. No. 3,531,195 issued to Tanaka, et al. in 1970 discloses a multi-color electrophotographic printing machine. As recited therein, the light image is filtered to record an electrostatic latent image on the photoconductive surface corresponding thereto. The electrostatic latent image is then developed with toner particles complimentary in color to the filtered light image. The toner powder image is then transferred to the sheet of support material. The foregoing process is repeated for successively differently colored light images. As described in Tanaka, each toner powder image is fused after being transferred to the sheet of support material. However, one skilled in the art will realize that all of the toner powder images may be fused after being transferred to the sheet of support material rather than being successively fused.

With the advent of multi-color electrophotographic printing, it has become desirable to create copies having portions thereof color highlighted. For example, portions of the original document may be selected and reproduced on the copy in a color different that the remainder thereof. In this manner, the copy will have portions in one color and the remainder thereof in another color. An arrangement of this type would be highly useful for emphasizing selected paragraphs or portions of a letter. In this case, a selected paragraph or line could be highlighted in red or blue and the remainder thereof would be reproduced in black. Thus, the apparatus of the present invention is directed to producing a copy having portions thereof color accented.

Accordingly, it is a primary object of the present invention to improve electrophotographic printing so as to create copies having portions thereof color highlighted.

SUMMARY OF THE INVENTION

Briefly stated, and in accordance with the present invention, there is provided an apparatus for forming a copy of an original document with portions of the copy being highlighted in a color other than the remainder thereof.

Pursuant to the present invention, means, in communication with the original document, select portions thereof to be reproduced in at least a first color. The remainder of the copy is reproduced in a second color. Reproducing means is provided for copying the original document. The reproducing means is operatively associated with the selecting means so as to produce copies having the selected portions in at least the first color with the remainder thereof being in the second color.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and the scope of the invention as defined by the appended claims.

DETAILED DESCRIPTION OF THE INVENTION

Figure 1:
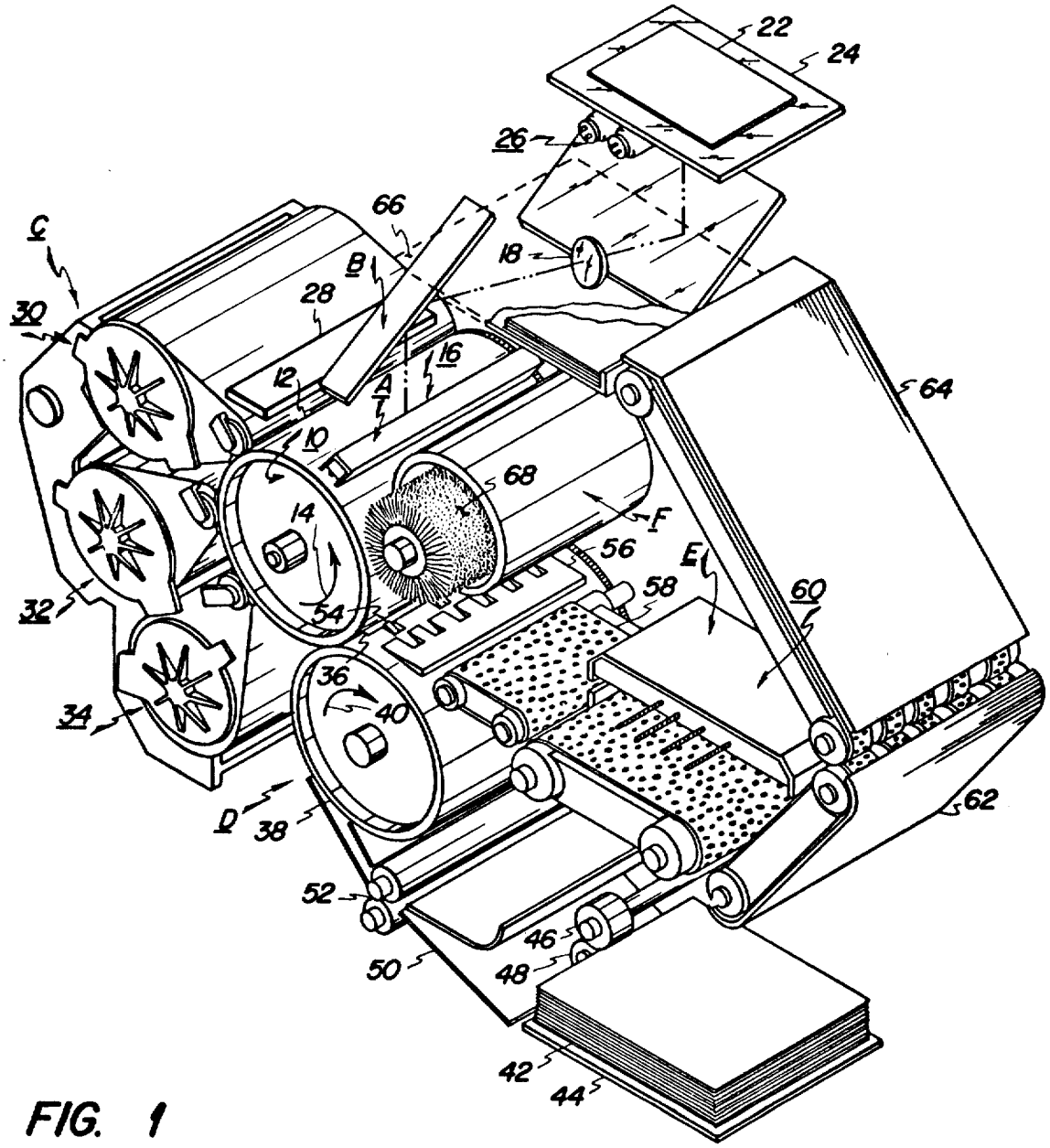
FIG. 1 is a schematic perspective view of an electrophotographic printing machine incorporating the features of the present invention therein.

An electrophotographic printing machine incorporating the features of the present invention is shown in FIG. 1. In the drawings, like reference numerals have been used throughout to designate like elements. The electrophotograhic printing machine described hereinafter has the capability of producing black and white copies as well as color highlighted copies. Although the present invention is depicted as being incorporated in an electrophotographic printing machine, it is obvious to one skilled in the art that the present invention is not necessarily limited to that particular embodiment and the present invention may be employed in various other types of printing machines.

As depicted in FIG. 1, the electrophotographic printing machine employs a photoconductive member having a drum 10 mounted rotatably within the machine frame (not shown). Photoconductive surface 12 is mounted on the exterior circumferential surface of drum 10 and entrained thereabout. One type of suitable photoconductive material is disclosed in U.S. Pat. No. 3,655,377 issued to Sechak in 1972.A series of processing stations are positioned about drum 10 such that as drum 10 rotates in the direction of arrow 14 it passes sequentially therethrough. Drum 10 is driven at a predetermined speed relative to the other machine operating mechanisms by a drive motor (not shown). A timing disc (not shown) mounted in the region of one end of the shaft of drum 10 cooperates with the machine logic to synchronize the various operations with the rotation of drum 10. In this manner, the proper sequence of events is produced at the respective processing stations.

Drum 10 initially rotates photoconductive surface 12 through charging station A. At charging station A, a corona generating device, indicated generally at 16, extends longitudinally in a transverse direction across photoconductive surface 12. Corona generating device 16 generates a spray of ions which are deposited on photoconductive surface 12 producing a relatively high, substantially uniform charge thereon. Corona generating device 16 is described in greater detail in copending application Ser. No. 307,250 filed on Nov. 16, 1972, now U.S. Pat. No. 3,942,006 issued to Hayne on Mar. 2, 1976, the disclosure of which is hereby incorporated into the present application.

Figure 3:
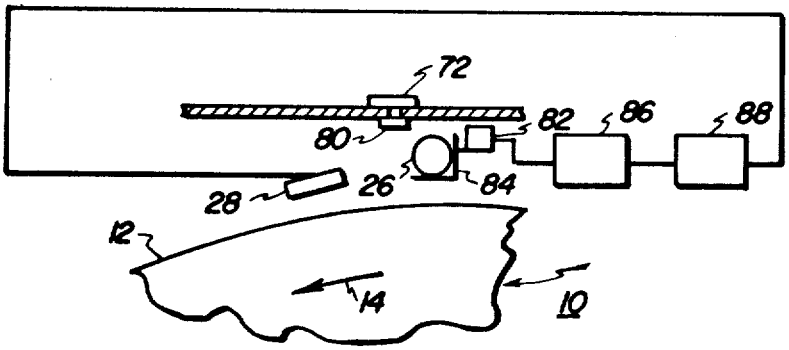
FIG. 3 is an elevational view, partially in section and fragmentary, of the FIG. 1 printing machine exposure system.
Figure 2:
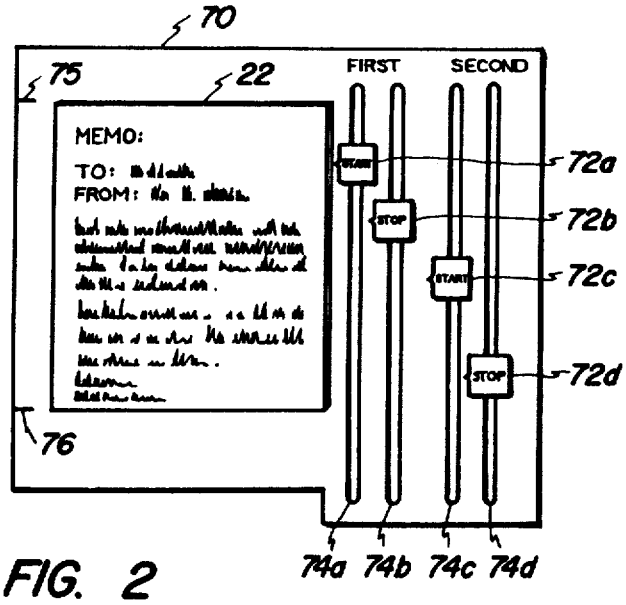
FIG. 2 is an elevational view of the color highlighting selector for the FIG. 1 printing machine.

After photoconductive surface 12 is charged to a substantially uniform potential, drum 10 is rotated to exposure station B. At exposure station B, a light image of an original document is projected onto charged photoconductive surface 12. Exposure station B includes a moving lens system generally designated by the reference numeral 18. Original document 22, such as a sheet of paper, book or the like is placed face down upon selecting means 24. Selecting means 24 includes a generally planar substantially transparent support member and indicator members (FIGS. 2 and 3). Circuit means couples the indicator members to the exposure system. Selecting means 24 will be described hereinafter in greater detail with reference to FIGS. 2 and 3. As shown in FIG. 1, lamps 26 are adapted to move in a timed relationship with lens 18 to scan successive incremental areas of original document 22. In this manner, a flowing light image of original document 22 is projected onto photoconductive surface 12 forming an electrostatic latent image thereon corresponding to the original document. Those portions of the electrostatic latent image being reproduced in black are erased therefrom leaving an electrostatic latent image on photoconductive surface 12 corresponding to the portions of the original document being reproduced in a color. Thereafter, the appropriate developer unit is actuated so as to deposit toner particles of the corresponding color on the latent image. The next successive light image is also of the entire original document. However, at this time, those portions of the original document hereinbefore developed in the first color are erased leaving only the portions being reproduced in black. The electrostatic latent image remaining on photoconductive surface 12 is then developed with black toner particles. The successive toner powder images are then transferred to a sheet of support material in registration with one another.

In the present invention, a flowing light image of the original document is projected onto photoconductive surface 12. Selecting means 24 actuates electroluminescent panel 28. Electroluminescent panel 28 projects light rays onto the electrostatic latent image recorded on photoconductive surface 12. The light rays from electroluminescent panel 28 erase those portions being reproduced in black. Thereafter, a flowing light image of the original document is again created. Selecting means 24, cooperating with the machine logic, energizes electroluminescent panel 28 so as to erase those portions hereinbefore reproduced in a highlighting color. The first-mentioned electrostatic latent image is then developed with the appropriately colored toner particles; and the second-mentioned latent image is developed with black toner particles.

After the electrostatic latent image is recorded on photoconductive surface 12, drum 10 rotates to development station C. At development station C, three individual developer units, generally indicated by the reference numerals 30, 32 and 34, respectively, are arranged to render visible the electrostatic latent image recorded on photoconductive surface 12. Preferably, the developer units are of a type generally referred to in the art as "magnetic brush developer units." A typical magnetic brush system employs a magnetized developer mix which includes carrier granules and toner particles. Generally, the toner particles are heat settable. In operation, the developer mix is continually brought through a directional flux field to form a brush thereof. The electrostatic latent image recorded on photoconductive surface 12 is brought into contact with the brush of developer mix. Toner particles are attracted from the developer mix to the latent image. Each of the developer units contain appropriately colored toner particles. For example, the electrostatic latent image corresponding to the color highlighted portions of the copy may be reproduced with red or cyan toner particles. The next successive latent image corresponding to the black portions of the copy are reproduced with black toner particles. Thus, resultant copy will have portions thereof in black and other portions thereof in red or cyan or, in lieu thereof, all three colors. While the present invention has been described as color highlighting a black and white copy with cyan or red, it is obvious to one skilled in the art that any colors may be employed for color highlighting. The development system employed in the FIG. 1 printing machine will be described in greater detail with reference to FIG. 4.

Drum 10 is next rotated to transfer station D where the powder image adhering electrostatically to photoconductive surface 12 is transferred to a sheet of final support material 36. Support material 36 may be plain paper or a sheet of thermoplastic material, amongst others. Transfer station D includes a transfer roll 38 which is electrically biased to a potential of sufficient magnitude and polarity to attract electrostatically the toner particles from the latent image recorded on photoconductive surface 12 to support material 36. Transfer roll 38 rotates in the direction of arrow 40 in synchronism with drum 10 to maintain the electrostatic latent image recorded on photoconductive surface 12 in registration with support material 36 secured releasably to transfer roll 38.

Successive toner powder images are transferred thereto in registration with one another. In this regard, the first toner powder image, i.e., red or cyan toner particles, are transferred to support material 36. Thereafter, the next toner powder image, i.e., black toner particles, are transferred to support material 36 in registration with the red or cyan toner particles previously transferred thereto. Thus, two toner powder images are deposited on support material 36, one corresponding to a portion of the original document being reproduced in black, and the other corresponding to the selected portion of the original document being color highlighted, i.e., in red or cyan. Prior to proceeding with the remainder of the electrophotographic printing process, the sheet feeding process will be briefly discussed.

Support material 36 is advanced from a stack 42 of sheet, mounted on tray 44. Feed roll 46, in operative communication with retard roll 48, advances and separates the uppermost sheet from stack 42. The advancing sheet moves into chute 50 which directs and guides it between register rolls 52. Thereafter, gripper fingers 54 mounted on transfer roll 38, secure releasably support material 36 thereto for movement therewith in a recirculating path. After the requisite number of toner powder images (two in the case of a single color highlight, three in the case of two highlights) have been transferred to support material 36, gripper fingers 54 release support material 36 and space it from transfer roll 38. Stripper bar 56 is then interposed between support material 36 and transfer roll 38 to separate support material 36 from transfer roll 38. Endless belt conveyor 58 then advances support material 36 to fixing station E.

At fixing station E, a fuser, indicated generally at 60, permanently affixes the transferred powder image to support material 36. Fuser 60 is described in greater detail in copending application Ser. No. 300,531, filed Oct. 25, 1972,now U.S. Pat. No. 3,826,892, the disclosure of which is hereby incorporated into the present application. After the fusing process, support material 36 is advanced by endless belt conveyors 62 and 64 to catch tray 66 permitting subsequent removal therefrom by the machine operator.

Although a preponderance of the toner particles are transferred to support material 36, invariably some residual toner particles remain on photoconductive surface 12 after the transfer of the powder image therefrom. Residual toner particles are removed from photoconductive surface 12 as it passes through cleaning station F. Here, the residual toner particles are first brought under the influence of a cleaning corona generating device (not shown) adapted to neutralize the electrostatic charge remaining on the residual toner particles and photoconductive surface 12. The neutralized toner particles are then cleaned from photoconductive surface 12 by a rotatably mounted fibrous brush in contact therewith. A suitable brush cleaning device is described in U.S. Pat. No. 3,590,412 issued to Gerbasi in 1971.

The electrophotographic printing machine hereinbefore described, has been described in greater detail in copending application Ser. No. 398,342, filed on Sept. 18, 1973, now U.S. Pat. No. 3,869,203, the disclosure of which is hereby incorporated into the present application. It is believed that the foregoing description is sufficient for purposes of the present application to depict the general operation of an electrophotographic printing machine embodying the features of the present invention therein. The remainder of the discussion will be directed to the specific subject matter of the various of assemblies of the present invention.

Turning now to FIG. 2, selecting means 24 is disclosed therein in greater detail. Selecting means 24 includes a substantially transparent, planar support member 70 having a plurality of indicator members 72 mounted slidably thereon. Indicator member **72*a* is adjusted so as to indicate the start of the first color highlighting portion. Indicator member 72*b* is adjusted so as to indicate the stop of the first color highlighting portion. Similarly, indicator members 72*c* and 72*d* are adjusted to indicate the start and stop, respectively, of the second color highlighting portion. In order to slidably adjust indicator members 72, support member 70 has a plurality of substantially parallel equally spaced slots 74 therein. In operation, original document 22 is disposed on support member 70 between locator marks 75 and 76, respectively. Thereafter, indicator member 72*a* is moved in slot 74*a* so as to locate the start of the first color highlighted portion on the copy. Indicator member 72*b* is also moved in slot 74*b* so as to locate the end of the first color highlighted portion. Similarly, indicator members 72*c* and 72*d* are moved in slot 74*c* and 74*d***, respectively, so as to locate the start and stop of the next color highlighting portion.

In the embodiment, illustrated in FIG. 2, only four indicator members are shown for creating two color highlighting portions. It will be obvious to one skilled in the art that any number of indicator members may be employed so as to create any number of color highlighting portions. However, one should note that a corresponding number of developer units would be required, each developer unit being associated with its corresponding color highlighting portion. The structure by which the indicator members actuate the electroluminescent panel will be described hereinafter with reference to FIG. 3.

Referring now to FIG. 3, each indicator member 72 has a magnet 80 disposed beneath support member 70. Magnet 80 actuates read switch 82 mounted on lamp carriage 84 of lamp assembly 26. Reed switch 82 is connected to electrical circuitry 86 adapted to actuate power supply 88 at the appropriate time. Power supply 88 excites electroluminescent panel 28. Circuit 86 may be a suitable timing circuit so as to actuate power supply 88 at the appropriate time. Circuit 86 will also contain two channels. The first channel is adapted to excite power supply 88 such that electroluminescent panel 28 or erase lamp 28 is actuated to project light rays onto photoconductive surface 12 to erase those portions of the electrostatic latent image corresponding to the black portions thereof. For example, erase lamp 28 will be actuated so as to project light rays onto photoconductive surface 12 after the electrostatic latent image corresponding to the entire original document is recorded thereon. Erase lamp 28 will be actuated at the appropriate time and only remain on a sufficient time so as to erase those portions of the electrostatic latent image encompassed by the start and stop indicator members. For example, if the original document contains 30 lines the electrostatic latent image formed on photoconductive surface 12 will also contain 30 lines. However, if the first 10 lines are to be reproduced in color, the start indicator member 72*a* will be disposed at line one and the stop indicator member 72*b* will be disposed at line 10. Erase lamp 28 will only be actuated so as to erase lines 10 through 30 of the electrostatic latent image. Thus, the electrostatic latent image formed on photoconductive surface 12 will correspond to lines one through 10. The foregoing is controlled by circuitry 86. A second electrostatic latent image of the original document is then recorded on photoconductive surface 12. However, at this time, the second channel of circuitry 86 is actuated. This channel actuates electroluminescent panel 28 so as to erase those portions of the original document corresponding to the color highlighted portions of the copy. For example, if the original document once again has 30 lines, and the first 10 lines are to be color highlighted, erase lamp 28 will be actuated so as to erase lines one through 10. Thus, the second electrostatic latent image will correspond to those portions of the original document being reproduced in black, i.e., lines ten through 30, inclusive. The foregoing may be achieved by controlling the speed of drum 10 and precisely locating panel 28 relative to the lead edge of the electrostatic latent image formed on drum 10. By controlling the angular velocity of drum 10 and preselecting the position of the lead edge of the electrostatic latent image, electroluminescent panel 28 may be actuated at the appropriate time to erase those portions of the electrostatic latent image desired. While the present invention has been described such that the black portions are initially erased from the electrostatic latent image of the original document and, thereafter, the color highlighted portions, one skilled in the art will appreciate that the present invention is not necessarily so limited and the reverse may also be true.

Figure 4:
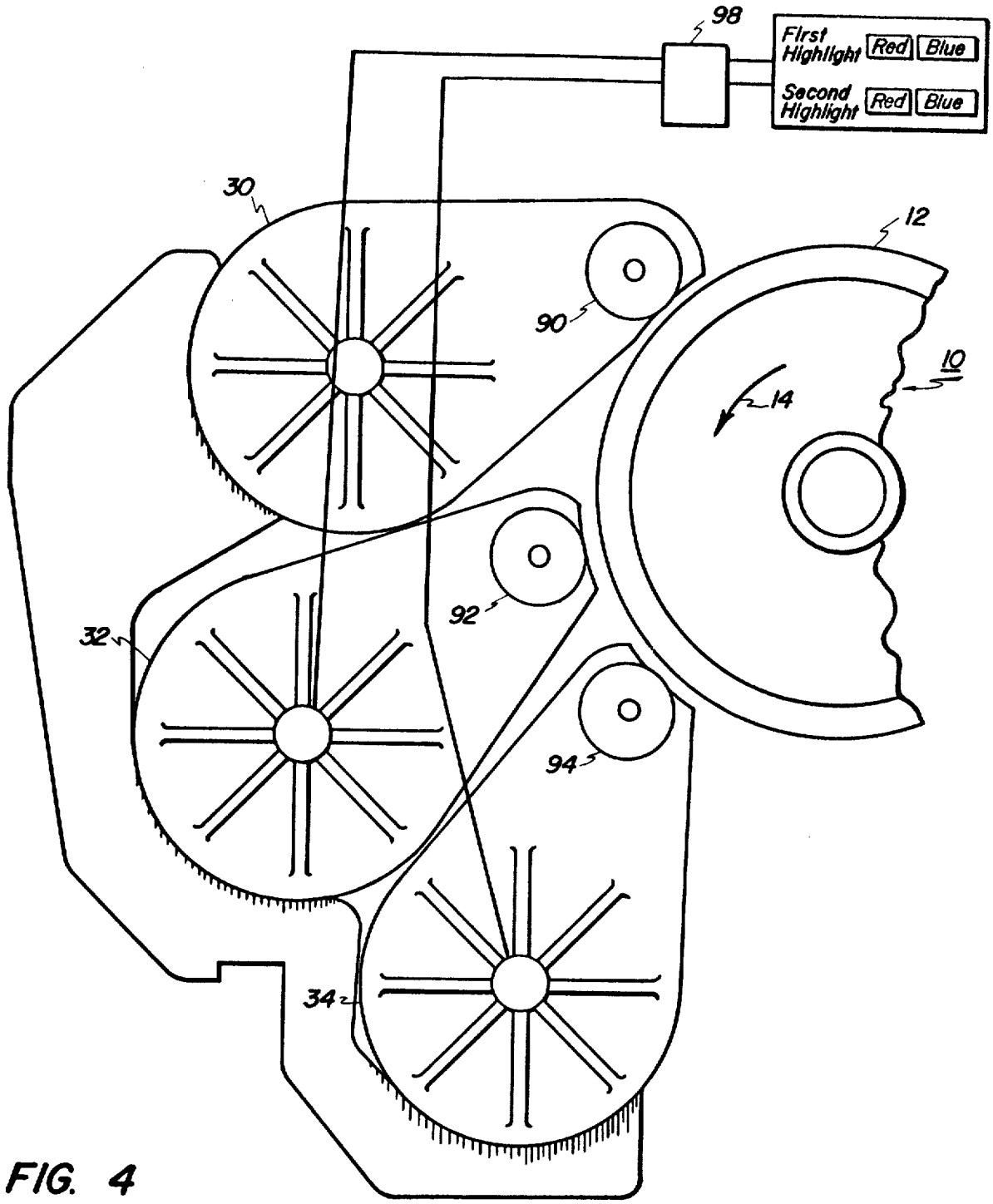
FIG. 4 is an elevational view, partially fragmentary, illustrating the development system and the control panel associated therewith for selecting the highlighting colors.

Referring now to FIG. 4, the development system of the FIG. 1 electrophotographic printing machine and the color highlighting procedure will be described with reference thereto. In the formation of black portions of the copy, only developer unit 30 is positioned in contact with the electrostatic latent image. Thus, after the color highlighted portions of the electrostatic latent image are erased from the electrostatic latent image by electroluminescent panel 28, developer unit 30 deposits black toner particles onto the electrostatic latent image. Developer unit 30 pivots from a non-operative position wherein developer roll 90 is spaced from photoconductive surface 12 to an operative position wherein the brush of developer mix is in contact with the electrostatic latent image. In this manner, black toner particles are deposited on the electrostatic latent image. Thereafter, the next electrostatic latent image of the color highlighted portions is developed with the appropriately colored toner particles. The actuation of developer unit 32 having red particles therein or developer unit 34 having cyan toner particles therein is controlled by control panel 96. For example, if the first highlight selected is red, developer unit 32 will pivot into position so that developer roll 92 is positioned such that the developer mix thereof contacts the second electrostatic image or the color highlighting electrostatic latent image. Contrawise, if the blue highlight is selected, developer unit 34 is pivoted such that developer roll 94 with the developer mix thereon is positioned adjacent to photoconductive surface 12 so as to enable the second electrostatic latent image to be developed with cyan toner particles. The selection of the appropriate color highlighting developer unit, i.e., red or cyan, is actuated by electrical circuitry 98. Circuitry 98 contains two channels and the associate logic therefor. One channel actuates the red developer unit, i.e., developer unit 32, and the other channel actuates the cyan developer unit, i.e., developer unit 34, at the appropriate time. Thus, if the first highlight selected is red, developer unit 32 will initially be actuated. Contrawise, if the first highlight is blue, developer unit 34 will be actuated. Similarly, if two highlights are actuated one being in red and the other being in blue, initially developer unit 32 will be actuated to develop the first color highlighting electrostatic latent image in red, and thereafter developer unit 34 will be actuated so as to develop the second color highlighting electrostatic image in cyan. The reverse may also be true, if the circuitry is wired in that manner.

In recapitulation, the apparatus of the present invention permits an electrophotographic printing machine to color highlight selected portions of a copy. In this process, the operator selects those portions of the original document to be color highlighted. A first electrostatic latent image is formed of the selected portions of the original document. The selected electrostatic latent image is developed with suitably color toner particles and transferred to a sheet of support material. A second electrostatic latent image is recorded on the photoconductive surface 12 corresponding to the non-selected portions of the original document. This electrostatic latent image is developed with black toner particles. These toner particles are then transferred to the support sheet in registration with the previously transferred color toner particles. This forms a toner powder image on the copy sheet in black with portions color highlighted. Thereafter, the powder image is permanently affixed to the sheet of support material by the application of suitable heat thereto. The resultant copy then corresponds to the original document with the exception that selected portions thereof are color highlighted in a preselected color. Hence, in the electrophotographic printing machine described heretofore a black and white copy may be created having portions thereof color highlighted in a plurality of selected colors.

Thus, it is apparent that it has been provided in accordance with the present invention, an electrophotographic printing machine that fully satisfies the objects, aims and advantages set forth above. While this invention has been disclosed in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A method of forming a copy of an original document with portions of the copy being highlighted in at least one color other than the remainder thereof, including the steps of:

positioning the original document on a substantially transparent support member;

adjusting an indicator movably mounted on the support member to select the portions of the original document being reproduced in at least a first color with the remainder thereof to be reproduced in a second color; and reproducing the original document so that the copy has the selected portions in at least the first color with the remainder thereof in the second color.

2. A method as recited in claim 1, wherein said step of reproducing includes the steps of:

forming a plurality of electrostatic latent images, one of the latent images corresponding to the portions of the original document to be reproduced in the first color and the other of the latent images corresponding to the remainder of the original document being reproduced in the second color;

developing the first mentioned latent image with toner particles of the first color and the second mentioned latent image with toner particles of the second color;

transferring the first and second color toner particles to a common copy sheet; and affixing substantially permanently the first and second color toner particles to the copy sheet forming a copy having portions thereof color highlighted.

3. A method as recited in claim 2, wherein said step of forming the latent images includes the steps of:

charging a photoconductive member to a substantially uniform potential;

projecting successive light images of the original document onto the charged photoconductive member recording successive electrostatic latent images thereon corresponding to the original document; and erasing portions of one of the latent images corresponding to the non-selected portions of the original document and portions of the next successive latent image corresponding to the selected portions of the original document.

4. A method as recited in claim 3, further including the step of generating an electrical signal indicative of the indicator location and controlling said step of erasing therewith.

* * * * *